US011062655B2

(12) United States Patent
Yin

(10) Patent No.: US 11,062,655 B2
(45) Date of Patent: Jul. 13, 2021

(54) PIXEL CIRCUIT, DISPLAY PANEL AND DRIVING METHOD THEREOF

(71) Applicant: BOE TECHNOLOGY GROUP CO., LTD., Beijing (CN)

(72) Inventor: Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/611,411

(22) PCT Filed: Apr. 5, 2019

(86) PCT No.: PCT/CN2019/081626
§ 371 (c)(1),
(2) Date: Nov. 6, 2019

(87) PCT Pub. No.: WO2019/196758
PCT Pub. Date: Oct. 17, 2019

(65) Prior Publication Data

US 2020/0168156 A1 May 28, 2020

(30) Foreign Application Priority Data

Apr. 10, 2018 (CN) ..... 201810315910.7

(51) Int. Cl.
*G09G 3/3258* (2016.01)

(52) U.S. Cl.
CPC ... *G09G 3/3258* (2013.01); *G09G 2300/0819* (2013.01); *G09G 2300/0842* (2013.01);
(Continued)

(58) Field of Classification Search
None
See application file for complete search history.

(56) References Cited

U.S. PATENT DOCUMENTS 7,446,740 B2 11/2008 Jung
9,633,603 B2 4/2017 Liu et al.
(Continued)

FOREIGN PATENT DOCUMENTS

CN 1658263 A 8/2005
CN 104200771 A 12/2014
(Continued)

OTHER PUBLICATIONS

Office Action dated Jun. 19, 2019 issued in corresponding Chinese Application No. 201810315910.7.
(Continued)

*Primary Examiner* — Matthew Yeung
(74) *Attorney, Agent, or Firm* — Nath, Goldberg & Meyer; Joshua B. Goldberg

(57) ABSTRACT

The disclosure provides a pixel circuit, a display panel and a driving method thereof. The pixel circuit includes a driving transistor, a threshold storage subcircuit, a threshold storage control subcircuit, a data storage subcircuit, a data writing control subcircuit, an isolation control subcircuit, a light-emitting control subcircuit and a light-emitting diode. The threshold storage control subcircuit is coupled to the threshold storage subcircuit. The threshold storage subcircuit stores the reference voltage input by the threshold storage control subcircuit, and stores a threshold voltage of the driving transistor. The data writing control subcircuit is coupled to the data storage subcircuit. The data storage subcircuit stores the data voltage input by the data writing control subcircuit. The isolation control subcircuit is coupled between the data storage subcircuit and the threshold storage subcircuit. The driving transistor is coupled to the threshold storage subcircuit and the data storage subcircuit.

13 Claims, 4 Drawing Sheets

(52) U.S. Cl.
CPC ..... *G09G 2310/0202* (2013.01); *G09G 2320/0233* (2013.01)

(56) References Cited

U.S. PATENT DOCUMENTS

| | | | | |
|---|---|---|---|---|
| 2005/0052377 | A1 | 3/2005 | Hsueh | |
| 2005/0140605 | A1* | 6/2005 | Jung | G09G 3/3233 345/76 |
| 2012/0007848 | A1* | 1/2012 | Han | G09G 3/3233 345/212 |
| 2017/0124950 | A1 | 5/2017 | Choi | |
| 2019/0114967 | A1 | 4/2019 | Yin | |

FOREIGN PATENT DOCUMENTS

| | | | |
|---|---|---|---|
| CN | 105513535 | A | 4/2016 |
| CN | 105976758 | A | 9/2016 |
| CN | 107507566 | A | 12/2017 |
| CN | 108447446 | A | 8/2018 |

OTHER PUBLICATIONS

Office Action dated Feb. 21, 2020 issued in corresponding Chinese Application No. 201810315910.7.

* cited by examiner

PIXEL CIRCUIT, DISPLAY PANEL AND DRIVING METHOD THEREOF

CROSS-REFERENCE TO RELATED APPLICATIONS

This is a National Phase Application filed under 35 U.S.C. 371 as a national stage of PCT/CN2019/081626, filed Apr. 5, 2019, an application claiming the benefit of Chinese patent application No. 201810315910.7, filed Apr. 10, 2018, the disclosure of each of which is incorporated herein by reference.

TECHNICAL FIELD

The disclosure relates to a pixel circuit, a display panel including the pixel circuit, and a method for driving the display panel.

BACKGROUND

With the development of display technology, organic light-emitting diode (OLED) display panels have been developed. The OLED display panel includes a plurality of pixel units, and each of the plurality of pixel units is provided therein with an organic light-emitting diode and a pixel circuit for driving the organic light-emitting diode to emit light.

In general, the pixel circuit for driving the organic light-emitting diode to emit light includes a driving transistor, a switching transistor, and a storage capacitor. The storage capacitor is configure to store a data voltage during a data voltage writing sub-stage.

SUMMARY

There is provided a pixel circuit, which includes a driving transistor, a threshold storage subcircuit, a threshold storage control subcircuit, a data storage subcircuit, a data writing control subcircuit, an isolation control subcircuit, a light-emitting control subcircuit and a light-emitting diode.

The threshold storage control subcircuit is electrically coupled to the threshold storage subcircuit and is configured to input a reference voltage into the threshold storage subcircuit in response to a first compensation control signal.

The threshold storage subcircuit is configured to store the reference voltage input by the threshold storage control subcircuit, and to store a threshold voltage of the driving transistor in response to the first compensation control signal.

The data writing control subcircuit is electrically coupled to the data storage subcircuit, and is configured to input a data voltage into the data storage subcircuit in response to a first scanning signal.

The data storage subcircuit is configured to store the data voltage input by the data writing control subcircuit.

The isolation control subcircuit is coupled between the data storage subcircuit and the threshold storage subcircuit, and is configured to he turned off or turned on in response to a light-emitting control signal for disconnecting or connecting the data storage subcircuit from or to the threshold storage subcircuit.

The driving transistor is electrically coupled to the threshold storage subcircuit and the data storage subcircuit, respectively, and is configured to control the light-emitting diode to emit light under control of the light-emitting control subcircuit, based on the threshold voltage stored in the threshold storage subcircuit and the data voltage stored in the data storage subcircuit, In some embodiments, the light-emitting control signal includes a first light-emitting control signal and a second light-emitting control signal.

A gate electrode of the driving transistor is electrically coupled to a first terminal of the threshold storage subcircuit, a first electrode of the driving transistor is electrically coupled to a first power supply voltage signal terminal and a first terminal of the data storage subcircuit, respectively, and a second electrode of the driving transistor is electrically coupled to a first terminal of the light-emitting control subcircuit and a third terminal of the threshold storage subcircuit, respectively.

A second terminal of the threshold storage subcircuit is electrically coupled to a first terminal of the threshold storage control subcircuit and a first terminal of the isolation control subcircuit, respectively, and a control terminal of the threshold storage subcircuit is electrically coupled to a control terminal of the threshold storage control subcircuit.

A second terminal of the threshold storage control subcircuit is electrically coupled to an input terminal of the data writing control subcircuit, when the control terminal of the threshold storage control subcircuit and the control terminal of the threshold storage subcircuit receive the first compensation control signal, the second terminal of the threshold storage control subcircuit is electrically connected with the first terminal of the threshold storage control subcircuit, and the first terminal of the threshold storage subcircuit is electrically connected with the third terminal of the threshold storage subcircuit, such that the reference voltage input through the threshold storage control subcircuit and the threshold voltage of the driving transistor are stored in the threshold storage subcircuit.

The data storage subcircuit is configured to store the data voltage output by the data writing control subcircuit, and a second terminal of the data storage subcircuit is electrically coupled to a second terminal of the isolation control subcircuit.

An output terminal of the data writing control subcircuit is electrically coupled to the second terminal of the data storage subcircuit, and the input terminal of the data writing control subcircuit is electrically connected with the output terminal of the data writing control subcircuit when a control terminal of the data writing control subcircuit receives a first scanning signal.

A control terminal of the isolation control subcircuit is electrically coupled to a control terminal of the light-emitting control subcircuit, and the first terminal of the isolation control subcircuit is disconnected from the second terminal of the isolation control subcircuit when the control terminal of the isolation control subcircuit receives the second light-emitting control signal.

A second terminal of the light-emitting control subcircuit is electrically coupled to an anode of the light-emitting diode, and the first terminal of the light-emitting control subcircuit is coupled to the second terminal of the light-emitting control subcircuit when the control terminal of the light-emitting control subcircuit receives the first light-emitting control signal.

In some embodiments, the isolation control subcircuit includes an isolation control transistor, wherein a gate electrode of the isolation control transistor serves as the control terminal of the isolation control subcircuit, a first electrode of the isolation control transistor serves as the first terminal of the isolation control subcircuit, and a second electrode of the isolation control transistor serves as the second terminal of the isolation control subcircuit.

The first electrode of the isolation control transistor is electrically connected with the second electrode of the isolation control transistor when the gate electrode of the isolation control transistor receives the first light-emitting control signal, and the first electrode of the isolation control transistor is disconnected from the second electrode of the isolation control transistor when the gate electrode of the isolation control transistor receives the second light-emitting control signal.

The first light-emitting control signal is opposite to the second light-emitting control signal in phase.

In some embodiments, the data storage subcircuit includes a data storage capacitor, wherein a first terminal of the data storage capacitor serves as the first terminal of the data storage subcircuit, and a second terminal of the data storage capacitor serves as the second terminal of the data storage subcircuit.

In some embodiments, the data writing control subcircuit includes a data writing transistor, wherein a gate electrode of the data writing transistor serves as the control terminal of the data writing control subcircuit, a first electrode of the data writing transistor serves as the input terminal of the data writing control subcircuit, and a second electrode of the data writing transistor serves as the output terminal of the data writing control subcircuit.

The first electrode of the data writing transistor is electrically connected with the second electrode of the data writing transistor when the gate electrode of the data writing transistor receives the first scanning signal, and the first electrode of the data writing transistor is disconnected from the second electrode of the data writing transistor when the gate electrode of the data writing transistor receives a second scanning signal.

The second scanning signal is opposite to the first scanning signal in phase.

In some embodiments, the threshold storage subcircuit comprises a compensation transistor and a threshold storage capacitor.

A gate electrode of the compensation transistor serves as the control terminal of the threshold storage subcircuit, a first electrode of the compensation transistor serves as the first terminal of the threshold storage subcircuit, and a second electrode of the compensation transistor serves as the third terminal of the threshold storage subcircuit.

The first electrode of the compensation transistor is electrically connected with the second electrode of the compensation transistor when the gate electrode of the compensation transistor receives the first compensation control signal, and the first electrode of the compensation transistor is disconnected from the second electrode of the compensation transistor when the gate electrode of the compensation transistor receives a second compensation control signal. The first compensation control signal is opposite to the second compensation control signal in phase.

A first terminal of the threshold storage capacitor is electrically coupled to the first electrode of the compensation transistor, and a second terminal of the threshold storage capacitor serves as the second terminal of the threshold storage subcircuit.

In some embodiments, the threshold storage control subcircuit includes a threshold storage control transistor. A gate electrode of the threshold storage control transistor serves as the control terminal of the threshold storage control subcircuit, a first electrode of the threshold storage control transistor serves as the first terminal of the threshold storage control subcircuit, and a second electrode of the threshold storage control transistor serves as the second terminal of the threshold storage control subcircuit.

The first electrode of the threshold storage control transistor is electrically connected with the second electrode of the threshold control transistor when the gate electrode of the threshold storage control transistor receives the first compensation control signal, and the first electrode of the threshold storage control transistor is disconnected from the second electrode of the threshold control transistor when the gate electrode of the threshold storage control transistor receives the second compensation control signal. The first compensation control signal is opposite to the second compensation control signal in phase.

In some embodiments, the light-emitting control subcircuit includes a light-emitting control transistor. A gate electrode of the light-emitting control transistor serves as the control terminal of the light-emitting control subcircuit, a first electrode of the light-emitting control transistor serves as the first terminal of the light-emitting control subcircuit, and a second electrode of the light-emitting control transistor serves as the second terminal of the light-emitting control subcircuit.

The first electrode of the light-emitting control transistor is electrically connected with the second electrode of the light-emitting control transistor when the gate electrode of the light-emitting control transistor receives the first light-emitting control signal, and the first electrode of the light-emitting control transistor is disconnected from the second electrode of the light-emitting control transistor when the gate electrode of the light-emitting control transistor receives the second light-emitting control signal. The first light-emitting control signal is opposite to the second light-emitting control signal in phase.

In some embodiments, the driving transistor is a P-type transistor, the first scanning signal has a low level, the second light-emitting control signal has a high level, and the first compensation control signal has a low level.

There is provided a display panel, which includes a plurality of gate lines, a plurality of data lines, and a plurality of light-emitting control signal lines, wherein the plurality of gate lines intersect with the plurality of data lines such that the display panel is divided into a plurality of pixel units, each row of pixel units corresponds to one gate line and one light-emitting control signal line, each column of pixel units corresponds to one data line, and a pixel circuit is provided in each pixel unit. The display panel further includes a plurality of compensation control signal lines, each row of pixel units corresponds to one compensation control signal line. The pixel circuit is the pixel circuit as described above. A control terminal of the data writing control subcircuit is electrically coupled to a corresponding gate line to receive the first scanning signal or a second scanning signal applied via the gate line; a control terminal of the threshold storage subcircuit is electrically coupled to a corresponding compensation control signal line to receive the first compensation control signal or a second compensation control signal applied via the compensation control signal line; an input terminal of the data writing control subcircuit is electrically coupled to a corresponding data line to receive the reference voltage or the data voltage applied via the data line; a second terminal of the threshold storage control subcircuit is electrically coupled to a corresponding data line to receive the reference voltage applied via the data line; and a control terminal of the threshold storage control subcircuit is electrically coupled to a corresponding compensation control signal line to receive the first compensation control signal or a second compensation control signal applied via the compensation control signal line.

A method for driving a display panel is provided. The display panel is the display panel according to the disclosure. A display period of each frame of image includes a field-blanking stage and a row scanning stage. The field-blanking stage includes a reset sub-stage and a threshold voltage storage sub-stage, and the row scanning stage includes a data voltage writing sub-stage and a light-emitting sub-stage. The method includes the steps of:

during the reset sub-stage, inputting, by the threshold storage control subcircuit, the reference voltage into the threshold storage subcircuit to reset the threshold storage subcircuit;

during the threshold voltage storage sub-stage, inputting, by the threshold storage control subcircuit, the reference voltage into the threshold storage subcircuit, and storing, by the threshold storage subcircuit, the threshold voltage of the driving transistor in response to the first compensation control signal;

during the data voltage writing sub-stage, inputting, by the data writing control subcircuit, the data voltage into the data storage subcircuit, and turning off the isolation control subcircuit in response to the second light-emitting control signal; and during the light-emitting sub-stage, inputting the threshold voltage of the driving transistor and the data voltage, by the threshold storage subcircuit and the data storage subcircuit, to the driving transistor, respectively.

In some embodiments, during the reset sub-stage, applying the first compensation control signal to all of the compensation control signal lines of the display panel, applying a second scanning signal to all of the gate lines of the display panel, applying a first light-emitting control signal to all of the light-emitting control signal lines of the display panel, and applying the reference voltage to all of the data lines of the display panel. The second scanning signal is opposite to the first scanning signal in phase.

During the threshold voltage storage sub-stage, applying the first compensation control signal to all of the compensation control signal lines of the display panel, applying the second scanning signal to all of the gate lines of the display panel, applying the second light-emitting control signal to all of the light-emitting control signal lines of the display panel, and applying the reference voltage to all of the data lines of the display panel. The second light-emitting control signal is opposite to the first light-emitting control signal in phase.

During the data voltage writing sub-stage, applying the second compensation control signal to all of the compensation control signal lines of the display panel, applying the first scanning signal to the gate lines in predetermined scanning sequence, applying corresponding data voltages to the data lines, and applying the second light-emitting control signal to all of the light-emitting control signal lines of the display panel, wherein the first scanning signal is applied to each gate line for a predetermined time.

During the light-emitting sub-stage, applying the second compensation control signal to all of the compensation control signal lines of the display panel, applying the second scanning signal to all of the gate lines of the display panel, and applying the first light-emitting control signal to all of the light-emitting control signal lines of the display panel.

In some embodiments, the driving transistor is a P-type transistor.

The first scanning signal has a low level, the second light-emitting control signal has a high level, and the first compensation control signal has a low level.

BRIEF DESCRIPTION OF THE DRAWINGS

The accompanying drawings, which provide a further understanding of the disclosure and constitute a part of the specification, are used in conjunction with the following specific embodiments to explain the disclosure, but are not intended to limit the disclosure. In the drawings.

DETAILED DESCRIPTION

Figure 1:
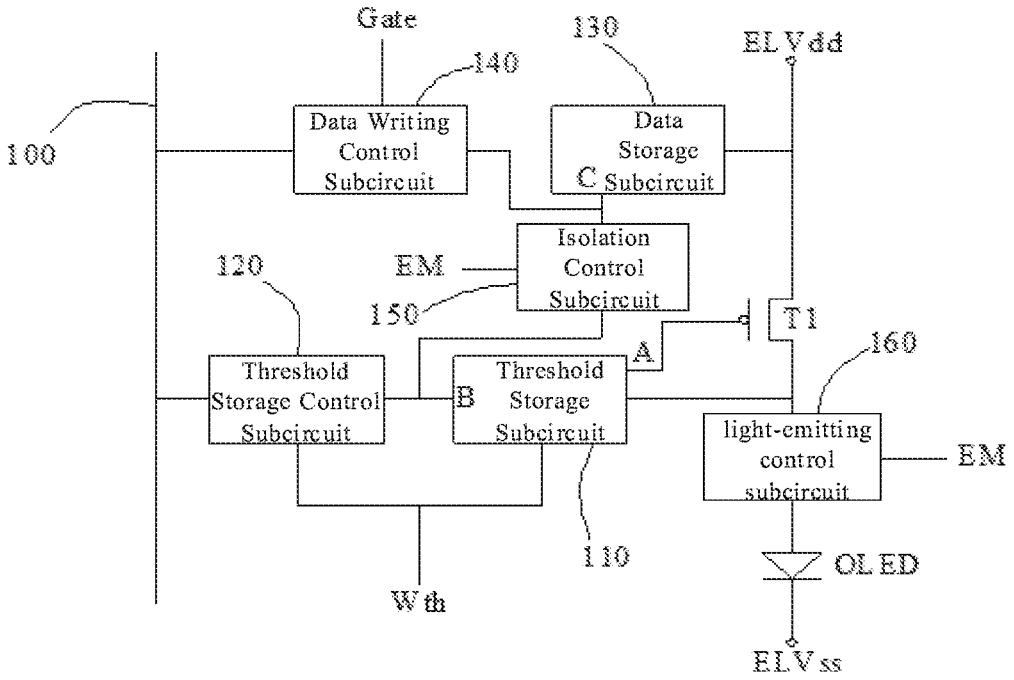
FIG. 1 is a schematic block diagram showing a pixel circuit according to the disclosure.

Exemplary embodiments of the disclosure will be described in detail below with reference to the accompanying drawings. It is to be understood that the embodiments described herein are merely for describing and explaining the disclosure rather than limiting the disclosure.

Due to the limitation of the precision of the manufacturing process, threshold voltages of the driving transistors of different pixel units may be different from each other, such that light-emitting brightnesses of the organic light-emitting diodes in different pixel units may not be uniform. In order to solve such a problem, it is necessary to provide a threshold compensation subcircuit in the pixel circuit. However, electric leakage is likely to occur in the pixel circuit in which the threshold compensation subcircuit is provided. Thus, how to reasonably design the threshold compensation subcircuit and prevent the occurrence of electric leakage in the pixel circuit in which the threshold compensation subcircuit is provided has become a technical problem to be solved urgently in the field. As an aspect of the disclosure, a pixel circuit is provided, wherein the pixel circuit includes a driving transistor T1, a threshold storage subcircuit 110, a threshold storage control subcircuit 120, a data storage subcircuit 130, a data writing control subcircuit 140, an isolation control subcircuit 150, a light-emitting control subcircuit 160, and an organic light-emitting diode (OLED).

In an embodiment of the disclosure, the driving transistor is electrically coupled to the threshold storage subcircuit 110 and the data storage subcircuit 130, respectively. The threshold storage control subcircuit 120 is electrically coupled to the threshold storage subcircuit 110, and is configured to write a reference voltage to the threshold storage subcircuit 110 in response to a first compensation control signal. The threshold storage subcircuit 110 is configured to store the reference voltage written by the threshold storage control subcircuit 120 and to store a threshold voltage of the driving transistor in response to the first compensation control signal. The data writing control subcircuit 140 is electrically coupled to the data storage subcircuit 130, and is configured to write a data voltage to the data storage subcircuit 130 in response to a first scanning signal. The data storage subcircuit 130 is configured to store the data voltage written by the data writing control subcircuit 140. The isolation control subcircuit 150 is coupled to the data storage subcircuit 130 and the threshold storage subcircuit 110, respectively, and is configured to be turned off in response to a second light-emitting control signal.

In the pixel circuit according to the disclosure, the data storage subcircuit 130 for storing the data voltage and the threshold storage subcircuit 110 for storing the threshold voltage of the driving transistor T1 are provided. The isolation control subcircuit 150 is disposed between the data storage subcircuit 130 and the threshold storage subcircuit 110, and is configured to be turned off in response to the second light-emitting control signal, thereby preventing the mutual influence on voltages in the data storage subcircuit 130 and the threshold storage subcircuit 110, and ensuring the stability of the circuit.

The pixel circuit of the embodiment of the disclosure will be described in detail below with reference to the accompanying drawings.

A gate electrode of the driving transistor T1 is electrically coupled to a first terminal A of the threshold storage subcircuit 110, a first electrode of the driving transistor T1 is electrically coupled to a first power voltage signal terminal (e.g., a high-level signal terminal) ELVdd and a first terminal of the data storage subcircuit 130, respectively, and a second electrode of the driving transistor T1 is electrically coupled to a first terminal of the light-emitting control subcircuit 160 and a third terminal of the threshold storage subcircuit 110, respectively.

A second terminal B of the threshold storage subcircuit 110 is electrically coupled to a first terminal of the threshold storage control subcircuit 120 and a first terminal of the isolation control subcircuit 150, respectively, and a control terminal of the threshold storage subcircuit 110 is electrically coupled to a control terminal of the threshold storage control subcircuit 120.

A second terminal of the threshold storage control subcircuit 120 is electrically coupled to an input terminal of the data writing control subcircuit 140. When the control terminal of the threshold storage control subcircuit 120 and the control terminal of the threshold storage subcircuit 110 receive the first compensation control signal, the second terminal of the threshold storage control subcircuit 120 is electrically connected with the first terminal of the threshold storage control subcircuit 120, and the first terminal A of the threshold storage subcircuit 110 is electrically connected with the third terminal of the threshold storage subcircuit 110, so as to store the voltage written by the threshold storage control subcircuit 120 and the threshold voltage of the driving transistor T1.

The data storage subcircuit 130 is configured to store the data voltage written by the data writing control subcircuit 140, and a second terminal C of the data storage subcircuit 130 is electrically coupled to a second terminal of the isolation control subcircuit 150.

An output terminal of the data writing control subcircuit 140 is electrically coupled to the second terminal C of the data storage subcircuit 130. When the control terminal of the data writing control subcircuit 140 receives the first scanning signal, the input terminal of the data writing control subcircuit 140 is electrically connected with the output terminal of the data writing control subcircuit 140.

A control terminal of the isolation control subcircuit 150 is electrically coupled to a control terminal of the light-emitting control subcircuit 160. When the control terminal of the isolation control subcircuit 150 receives a first light-emitting control signal, the first terminal of the isolation control subcircuit 150 is electrically connected with the second terminal of the isolation control subcircuit 150. When the control terminal of the isolation control subcircuit 150 receives the second light-emitting control signal, the first terminal of the isolation control subcircuit 150 is disconnected from the second terminal of the isolation control subcircuit 150.

A second terminal of the light-emitting control subcircuit 160 is electrically coupled to an anode of the light-emitting diode OLED. When the control terminal of the light-emitting control subcircuit 160 receives the first light-emitting control signal, the first terminal of the light-emitting control subcircuit 160 is electrically connected with the second terminal of the light-emitting control subcircuit 160.

In the pixel circuit according to the embodiment of the disclosure, the data storage subcircuit 130 for storing the data voltage and the threshold storage subcircuit 110 for storing the threshold voltage of the driving transistor T1 are provided. A reset voltage for resetting and the data voltage for driving the light-emitting diode OLED to emit light can be written through a same signal line, so that the number of signal lines of a display panel including the pixel circuit can be reduced, which is advantageous for improving the resolution of the display panel.

The operation principle of the pixel circuit according to the disclosure will be described in detail below with reference to an example timing diagram shown in FIG. 3. It should be explained that, in the disclosure, the first compensation control signal is opposite to the second compensation control signal in phase, and the first scanning signal is opposite to the second scanning signal in phase.

Figure 3:
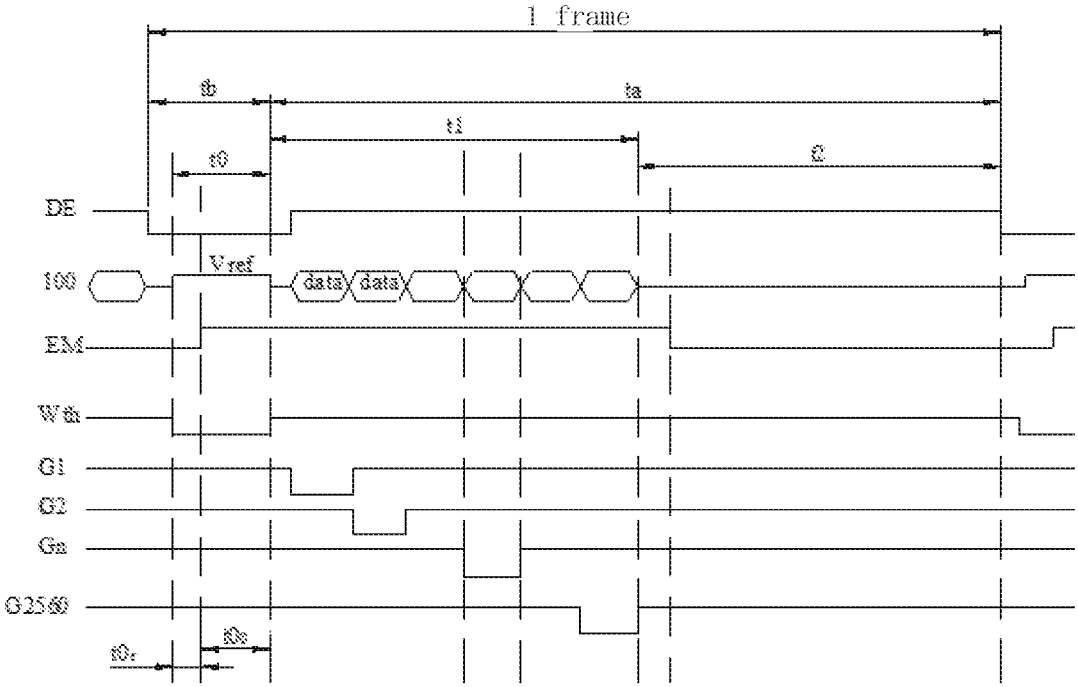
FIG. 3 is a timing diagram of a pixel circuit according to the disclosure.
Figure 4:
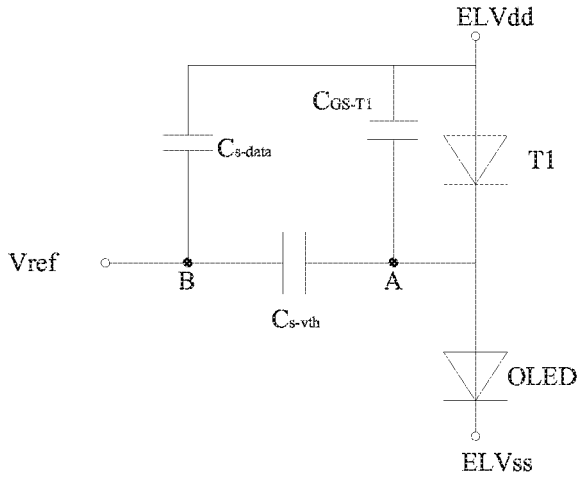
FIG. 4 is an equivalent circuit diagram of the pixel circuit shown in FIG. 2 during a reset sub-stage.
Figure 5:
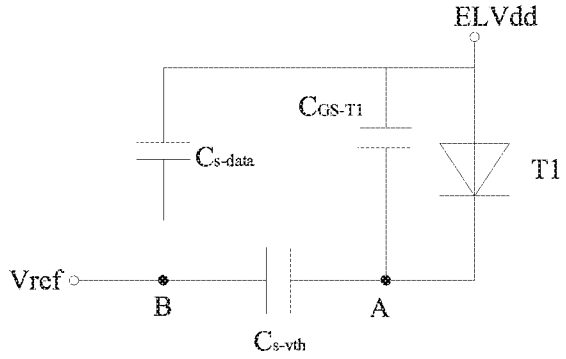
FIG. 5 is an equivalent circuit diagram of the pixel circuit shown in FIG. 2 during a threshold voltage storage sub-stage.

In FIG. 3, DE (Data enable signal) represents an active data strobe signal for enabling input of signals of signal terminals.

The pixel circuit according to the disclosure may be applied to the display panel, and the display panel includes a plurality of pixel units, the pixel circuit being provided in each of the pixel units. As shown in FIG. 1, when the pixel unit is applied to the display panel, the input terminal of the data writing control subcircuit 140 is electrically coupled to a data line 100, the control terminal of the threshold storage subcircuit 110 is electrically coupled to a compensation control signal line Wth, and the control terminal of the data writing control subcircuit 140 is electrically coupled to a gate line. For example, a control terminal of a data writing control subcircuit 140 of a pixel circuit of the pixel unit in the $n^{th}$ row is electrically coupled to the gate line Gn. When each frame of image is displayed, an operation cycle of the display panel includes a field-blanking stage (V-blank) tb and a row scanning stage (V-active) ta.

In the display panel according to the disclosure, compensation of the threshold voltage Vth of the driving transistor in the pixel circuit within one frame includes three stages, i.e., a threshold voltage refreshing stage, a data refreshing stage, and a light-emitting stage. In the threshold voltage refreshing stage, the threshold voltage Vth of the driving transistor in the corresponding pixel is written into the threshold storage subcircuit. In the data refreshing stage, pixel data is written into the data storage subcircuits within corresponding pixel circuits in each row in a way of row-by-row scanning. In the light-emitting stage, the threshold voltage Vth of the driving transistor stored in the threshold storage subcircuit and the data voltage Vdata stored in the data storage subcircuit are applied to the gate electrode and the source electrode of the driving transistor, respectively, such that the driving transistor provides a driving current for driving the light-emitting diode to emit light. The threshold voltage refreshing stage t0 is within the field-blanking stage tb, and the threshold voltage refreshing stage t0 includes a reset sub-stage $t0_r$ and a threshold voltage storage sub-stage $t0_0$. It is to be noted that the reset sub-stage $t0_r$ may last for a first predetermined time h1, and the threshold voltage storage sub-stage $t0_0$ may last for a second predetermined time h2. During the reset sub-stage $t0_r$, the light-emitting diode OLED emits light. The duration of the reset sub-stage $t0_r$ should be reduced as much as possible in order to improve the display contrast, and it is only necessary to reduce a voltage at the first terminal of the threshold storage subcircuit to ELVdd-max (Vth), where max (Vth) is an absolute value of a maximum value of threshold voltages Vth in all pixels in the display panel. The longer the second predetermined, time, the higher the charging rate of the threshold voltage of the driving transistor, and the better the compensation effect. However, the sum of the first predetermined time h1 and the second predetermined time h2 should be less than the duration of the field-blanking stage tb.

During the reset sub-stage $t0_r$, a reference voltage Vref is applied to the second terminal of the threshold storage control subcircuit 120 and the input terminal of the data writing control subcircuit 140, the first compensation control signal is applied to the control terminal of the threshold storage control subcircuit 120 and the control terminal of the threshold storage subcircuit 110, the second scanning signal is applied to the control terminal of the data writing control subcircuit 140, the reference voltage Vref is applied to the input terminal of the data writing control subcircuit 140, and, the first light-emitting control signal is applied to the control terminal of the light-emitting control subcircuit 160. Accordingly, the first terminal A of the threshold storage subcircuit 110 is electrically connected with the third terminal of the threshold storage subcircuit 110, so that the driving transistor T1 forms a diode connection. The first terminal of the isolation control subcircuit 150 is electrically connected with the second terminal of the isolation control subcircuit 150, and the first terminal of the light-emitting control subcircuit 160 is electrically connected with the second terminal of the light-emitting control subcircuit. The gate electrode and the second electrode of the driving transistor T1 charges the anode of the light-emitting diode OLED, such that a voltage at the gate electrode of the driving transistor T1 and the first terminal A of the threshold storage subcircuit 110 is clamped to a voltage at the anode of the light-emitting diode OLED. In general, the anode voltage VA of the light-emitting diode OLED is less than the difference between the high-level voltage ELVdd supplied from the first power voltage signal terminal and the threshold voltage Vth of the driving transistor T1 (i.e., VA<ELVdd−Vth), thereby resetting the gate electrode of the driving transistor T1. The first terminal of the threshold storage control subcircuit 120 is electrically connected with the second terminal of the threshold storage control subcircuit 120 for writing the reference voltage Vref into the second terminal B of the threshold storage subcircuit 110, thereby resetting the second terminal B of the threshold storage subcircuit 110.

During the threshold voltage storage sub-stage $t0_0$ after the reset sub-stage $t0_r$, the reference voltage Vref is applied to the second terminal of the threshold storage control subcircuit 120 and the input terminal of the data writing control subcircuit 140, the first compensation control signal is applied to the control terminal of the threshold storage control subcircuit 120 and the control terminal of the threshold storage subcircuit 110, the second scanning signal is applied to the control terminal of the data writing control subcircuit 140, the reference voltage Vref is applied to the input terminal of the data writing control subcircuit 140, and the second light-emitting control signal is applied to the control terminal of the light-emitting control subcircuit 160. Accordingly, the first terminal of the isolation control subcircuit 150 is disconnected from the second terminal of the isolation control subcircuit 150, and the first terminal of the light-emitting control subcircuit 160 is disconnected from the second terminal of the light-emitting control subcircuit 160. The input terminal of the data writing control subcircuit 140 is disconnected from the output terminal of the data writing control subcircuit 140. The first terminal of the threshold storage control subcircuit 120 is electrically connected with the second terminal of the threshold storage control subcircuit 120. The first terminal A of the threshold storage subcircuit 110 is electrically connected with the third terminal of the threshold storage subcircuit 110. At this time, the threshold storage subcircuit 110 is charged by the first power voltage signal terminal ELVdd through the driving transistor T1 in the state of diode connection. At the same time, the reference voltage Vref written through the data line is also written into the threshold storage subcircuit 110, so that the voltage charged in the threshold storage subcircuit 110 is ELVdd-Vth-Vref. At this stage, the threshold voltage of the driving transistor is stored in the threshold storage subcircuit 110. Since the first terminal of the isolation control subcircuit 150 is disconnected from the second terminal of the isolation control subcircuit 150, the voltage charged in the threshold storage subcircuit 110 may not be written into the data storage subcircuit 130.

A data voltage writing sub-stage t1 and a light-emitting sub-stage t2 are both within the row scanning stage ta, and the sum of the duration of the data voltage writing sub-stage t1 and the duration of the light-emitting sub-stage t2 is not more than the duration $t_{a0}$ of the row scanning stage ta (not shown). Generally, the duration of the light-emitting sub-stage t2 of the light-emitting diode is set according to the efficiency, a driving current, the required display brightness of the light-emitting diode. A result obtained by subtracting the duration of the light-emitting sub-stage t2 from the duration $t_{a0}$ of the row scanning stage to is set as the scanning time (i.e., duration) t10 (not shown) of the data voltage writing sub-stage t1 in the disclosure, and the scanning time t10 is divided by the total number of rows to obtain the scanning time of each row.

A practical row scanning time(i.e., scanning time of each row) t10/N in an embodiment of the present disclosure is less than the row scanning time $t_{a0}$/N, where N is the total number of rows (i.e., the total number of the gate lines) and ta0 is scanning time for all rows.

During the data voltage writing sub-stage t1, the data voltage is applied to the second terminal of the threshold storage control subcircuit 120 and the input terminal of the data writing control subcircuit 140, the second compensation control signal is applied to the control terminal of the threshold storage control subcircuit 120 and the control terminal of the threshold storage subcircuit 110, the first scanning signal is applied to the control terminal of the data writing control subcircuit 140, and the second light-emitting control signal is applied to the control terminal of the light-emitting control subcircuit 160. During the data voltage writing sub-stage, since the first terminal A of the threshold storage subcircuit 110 is disconnected from the third terminal of the threshold storage subcircuit 110, the driving transistor T1 does not exhibit diode characteristics and is in an off-state. At this time, the first scanning signal is applied via the Gate line Gate, so that the input terminal of the data writing control subcircuit 140 is electrically connected with the output terminal of the data writing control subcircuit 140 for writing the data voltage into the data storage subcircuit 130. Since the first terminal of the isolation control subcircuit 150 is disconnected from the second terminal of the isolation control subcircuit 150, the data voltage may not be written into the threshold storage subcircuit 110.

During the light-emitting sub-stage t2, a second compensation control signal is applied to the control terminal of the threshold storage control subcircuit 120 and the control terminal of the threshold storage subcircuit 110, the second scanning signal is applied to the control terminal of the data writing control subcircuit 140, and the first light-emitting control signal is applied to the control terminal of the light-emitting control subcircuit 160. Accordingly, the first terminal of the light-emitting control subcircuit 160 is electrically connected with the second terminal of the light-emitting control subcircuit 160. A voltage formed by the charges stored in the threshold storage subcircuit 110 and a voltage formed by the charges stored in the data storage subcircuit 130 are applied to the gate electrode and the source electrode (i.e., the first electrode) of the driving transistor T1, respectively, such that the driving transistor T1 is turned on, and a driving current is generated.

Since during the threshold voltage refreshing stage to within the field-blanking stage tb, the threshold voltage Vth of the driving transistor is stored in the threshold storage subcircuit 110, the driving current generated by the driving transistor T1 is independent of the threshold voltage of the driving transistor T1 during the light-emitting sub-stage.

It should be noted that, in an embodiment of the disclosure, both of the control terminal of the isolation control subcircuit 150 and the control terminal of the light-emitting control subcircuit 160 may be coupled to the same signal terminal and receive the same signal. In another embodiment of the disclosure, the control terminal of the isolation control subcircuit 150 and the control terminal of the light-emitting control subcircuit 160 may be coupled to different signal terminals and receive different signals, as long as the isolation control subcircuit 150 is in an off-state when the data storage subcircuit 130 stores the data voltage, so as to prevent the data voltage stored in the data storage subcircuit 130 from leaking to the threshold storage subcircuit 110.

In the disclosure, the reference voltage Vref for resetting and the data voltage are applied to the pixel circuit via the data line, therefore a reset signal line for specially applying the reference voltage may not be provided. Thus, the number of wires in the display panel including the pixel circuit may be reduced, and more pixel units may be provided in the display panel, thereby improving the resolution of the display panel.

In addition, in the disclosure, the refreshing of the threshold voltages of driving transistors in all pixel circuits is performed in the field-blanking stage, therefore the compensation control signal for controlling the threshold storage control subcircuit 120 and the threshold storage subcircuit 110 is a level signal instead of a scanning signal, which can simplify the design of the driving circuit. Similarly, the light-emitting control signal for controlling the light-emitting control subcircuit 160 is also a level signal instead of a scanning signal, which also can simplify the design of the driving circuit. Therefore, the pixel circuit according to the embodiment of the disclosure facilitates a narrow frame of the display panel.

In the pixel circuit according to the disclosure, the data voltage is stored in the data storage subcircuit, and the threshold voltage of the driving transistor is stored in the threshold storage subcircuit, therefore the data voltage and the threshold voltage of the driving transistor can be stored at different stages, respectively. As described above, the threshold voltage of the driving transistor is stored in the threshold storage subcircuit during the field-blanking stage tb. The field-blanking stage tb lasts for a long time (which may be set as a time for scanning several gate lines or even several tens of gate lines), and the reset sub-stage $t0_r$ lasts for the first predetermined time hi that may be set to be relatively short, therefore the threshold voltage storage sub-stage $t0_0$ lasts for the second predetermined time h2 that may be set to be relatively long (for example, the second predetermined time h2 may be set as a time for scanning several gate lines to several tens of gate lines), which is much longer than a time (e.g., for scanning one gate line) for writing the threshold voltage in the related art, thereby improving the charging rate of the threshold storage subcircuit by the driving transistor in a case where the driving transistor is in the diode state, realizing the more accurate writing of the threshold voltage of the driving transistor, and further improving uniformity of the light-emitting of the display panel.

Further, in the disclosure, the data voltage is stored in the data storage subcircuit, the threshold voltage of the driving transistor is stored in the threshold storage subcircuit. During the data voltage writing sub-stage, the data storage subcircuit is isolated from the threshold storage subcircuit by the isolation control subcircuit, therefore the mutual influence between the threshold voltage and the data voltage can be prevented, and the stability of the circuit can be ensured.

Figure 2:
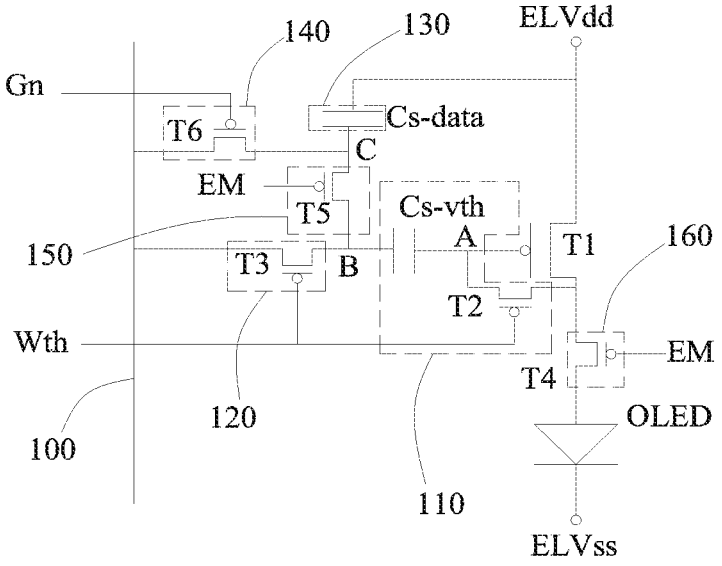
FIG. 2 is a schematic circuit diagram showing a pixel circuit according to the disclosure.

In the disclosure, the specific type of the data storage subcircuit 130 is not limited, as long as the data voltage can be stored therein during the data voltage writing sub-stage. In order to simplify the structure of the pixel circuit, optionally, the data storage subcircuit 130 may include a data storage capacitor Cs-data, as shown in FIG. 2. Specifically, a first terminal of the data storage capacitor Cs-data is formed as (e.g., serves as) the first terminal of the data storage subcircuit 130, and a second terminal of the data storage capacitor Cs-data is formed as the second terminal C of the data storage subcircuit 130. The data voltage written by the data writing control subcircuit 140 may be directly stored in the data storage capacitor Cs-data.

As an optional embodiment, the data writing control subcircuit 140 may include a data writing transistor T6. A gate electrode of the data writing transistor T6 is formed as the control terminal of the data writing control subcircuit 140, a first terminal of the data writing transistor T6 is formed as the input terminal of the data writing control subcircuit 140, and a second electrode of the data writing transistor T6 is formed as the output terminal of the data writing control subcircuit 140.

The first electrode and the second electrode of the data writing transistor T6 can be electrically connected with each other when the gate electrode of the data writing transistor T6 receives the first scanning signal. Also, the first electrode of the data writing transistor T6 can be disconnected from the second electrode of the data writing transistor T6 when the gate electrode of the data writing transistor T6 receives the second scanning signal.

In the disclosure, the specific structure of the isolation control subcircuit 150 is not limited. In order to simplify the structure of the pixel circuit, optionally, the isolation control subcircuit 150 includes an isolation control transistor T5, as shown in FIG. 2. A gate electrode of the isolation control transistor T5 is formed as the control terminal of the isolation control subcircuit 150, a first electrode of the isolation control transistor T5 is formed as the first terminal of the isolation control subcircuit 150, and a second electrode of the isolation control transistor T5 is formed as the second terminal of the isolation control subcircuit 150. The first electrode and the second electrode of the isolation control transistor T5 can be electrically connected with each other when the gate electrode of the isolation control transistor T5 receives the first light-emitting control signal, and the first electrode of the isolation control transistor T5 can be disconnected from the second electrode of the isolation control transistor T5 when the gate electrode of the isolation control transistor T5 receives the second light-emitting control signal In order to simplify the structure of the pixel circuit, optionally, the threshold storage subcircuit 110 includes a compensation transistor T2 and a threshold storage capacitor Cs-Vth.

As shown in FIG. 2, a gate electrode of the compensation transistor T2 is formed as the control terminal of the threshold storage subcircuit 110, a first electrode of the compensation transistor T2 is formed as the first terminal A of the threshold storage subcircuit 110, and a second electrode of the compensation transistor T2 is formed as the third terminal of the threshold storage subcircuit 110. The first electrode and the second electrode of the compensation transistor T2 can be electrically connected with each other when the gate electrode of the compensation transistor T2 receives the first compensation control signal, and the first electrode of the compensation transistor T2 can be disconnected from the second electrode of the compensation transistor T2 when the gate electrode of the compensation transistor T2 receives the second compensation control signal.

A first terminal of the threshold storage capacitor Cs-Vth is electrically coupled to the first electrode of the compensation transistor T2, and a second terminal of the threshold storage capacitor Cs-Vth is formed as the second terminal B of the threshold storage subcircuit 110.

As an optional embodiment of the disclosure, the threshold storage control subcircuit 120 includes a threshold storage control transistor T3. A gate electrode of the threshold storage control transistor T3 is formed as the control terminal of the threshold storage control subcircuit 120, a first electrode of the threshold storage control transistor T3 is formed as the first terminal of the threshold storage control subcircuit 120, and a second electrode of the threshold storage control transistor T3 is formed as the second terminal of the threshold storage control subcircuit 120.

The first electrode and the second electrode of the threshold storage control transistor T3 can be electrically connected with each other when the gate electrode of the threshold storage control transistor T3 receives the first compensation control signal, and the first electrode of the threshold storage control transistor T3 can be disconnected from the second electrode of the threshold storage control transistor T3 when the gate electrode of the threshold storage control transistor T3 receives the second compensation control signal.

In order to simplify the structure of the pixel circuit, optionally, the light-emitting control subcircuit 160 includes a light-emitting control transistor T4. A gate electrode of the light-emitting control transistor T4 is formed as the control terminal of the light-emitting control subcircuit 160, a first electrode of the light-emitting control transistor T4 is formed as the first terminal of the light-emitting control subcircuit 160, and a second electrode of the light-emitting control transistor T4 is formed as the second terminal of the light-emitting control subcircuit 160.

The first electrode and the second electrode of the light-emitting control transistor T4 can be electrically connected with each other when the gate electrode of the light-emitting control transistor T4 receives the first light-emitting control signal, and the first electrode of the light-emitting control transistor T4 can be disconnected from the second electrode of the light-emitting control transistor T4 when the gate electrode of the light-emitting control transistor T4 receives the second light-emitting control signal.

In an embodiment of the disclosure, as shown in FIGS. 1 and 2, the driving transistor T6 is a P-type transistor, and accordingly, the first scanning signal has a low level, and the second scanning signal has a high level.

For convenience of manufacturing and control, optionally, the first light-emitting control signal has a low level, and the second light-emitting control signal has a high level. The first compensation control signal has a low level, and the second compensation control signal has a high level. Accordingly, all transistors in the pixel circuit are P-type transistors. That is, in the embodiment shown in FIG. 2, the compensation transistor T2, the threshold storage control transistor T3, the light-emitting control transistor T4, the isolation control transistor T5, and the data writing transistor T6 are all P-type transistors.

It should be noted that the driving transistor T6 may be an N-type transistor, and accordingly, the first scanning signal has a high level, and the second scanning signal has a low level.

For convenience of manufacturing and control, optionally, the first light-emitting control signal has a high level, and the second light-emitting control signal has a low level. The first compensation control signal has a high level, and the second compensation control signal has a low level. Accordingly, all transistors in the pixel circuit are N-type transistors.

Further, in an embodiment, the first electrodes of all the transistors in the pixel circuit may be source electrodes, and the second electrodes may be drain electrodes. Alternatively, the first electrodes of all the transistors in the pixel circuit may be drain electrodes, and the second electrodes may be source electrodes.

As a second aspect of the disclosure, as shown in FIGS. 1 and 2, a display panel is provided, which includes a plurality of gate lines, a plurality of data lines 100, and a plurality of light-emitting control signal lines EM. The plurality of gate lines intersect with the plurality of data lines 100, such that the display panel is divided into a plurality of pixel units. Each row of pixel units corresponds to one gate line and one light-emitting control signal line, and each column of pixel units corresponds to one data line. A pixel circuit is disposed in each pixel unit. The display panel further includes compensation control signal lines Wth, and each row of pixel units corresponds to one compensation control signal line Wth. The pixel circuit is the pixel circuit according to the disclosure. The control terminal of the data writing control subcircuit 140 is electrically coupled to a corresponding gate line, the control terminal of the threshold storage subcircuit 110 is electrically coupled to a corresponding compensation control signal line Wth, and the input terminal of the data writing control subcircuit 140 is electrically coupled to a corresponding data line 100.

The display panel can display without having a reset signal line, therefore more pixel units can be arranged in a display area to obtain higher resolution.

A period of each frame of the display panel includes the field-blanking stage tb (V-blank) and the row scanning stage ta (V-active) in the display panel according to the disclosure, during the field-blanking stage, a threshold storage process is performed in the pixel circuits in all pixel units. During the row scanning stage ta, rows of pixel units are scanned in sequence, and data voltages are applied to columns of pixel units in sequence to enable the light-emitting diodes MED in the pixel units to emit light. Specifically, the row scanning stage ta is divided into two phases including the data voltage writing sub-stage t1 and the light-emitting sub-stage t2. During the data voltage writing sub-stage, scanning of pixel units in each row and writing of data voltages into pixel units in each column are performed. During the light-emitting sub-stage, all the pixel units are controlled to emit light for display together. In the disclosure, all the pixel units emit light generally in the second half of a frame, which is beneficial to the mixing of light in different colors emitted by the pixel units and obtaining better display effect.

As an optional embodiment, the pixel circuit is the pixel circuit shown in FIG. 2. The operation principle of the display panel including the pixel circuit shown in FIG. 2 is explained, and illustrated in detail below with reference to FIGS. 2 to 7.

The display panel according to the disclosure includes a plurality of gate lines. In the embodiment shown in FIG. 3, a display panel with resolution of 1440×2560 includes 2560 gate lines is taken as an example, wherein G1 denotes a first gate line, G2 denotes a second gate line, Gn denotes an $n^{th}$ gate line, and G2560 denotes a $2560^{th}$ gate line. A cathode of the light-emitting diode OLED is electrically coupled, to a second power voltage signal terminal (e.g., a low-level signal terminal) ELVss.

As shown in FIG. 3, the field-blanking stage tb includes the threshold voltage refreshing stage t0, and the threshold voltage refreshing stage t0 includes the reset sub-stage $t0_r$ and the threshold voltage storage sub-stage $t0_0$. In other words, a refreshing stage t0 for the threshold voltage Vth includes the reset sub-stage $t0_r$ and the threshold voltage storage sub-stage $t0_0$. As described above, the reset sub-stage $t0_r$ may last for the first predetermined time h1, and the threshold voltage storage sub-stage $t0_0$ may last for the second predetermined time h2, where h1<h2. During the reset sub-stage $t0_r$, the light-emitting diode OLED emits light. The duration of the reset sub-stage $t0_r$ should not be too long in order to improve the display contrast.

During the reset sub-stage $t0_r$, the first compensation control signal is applied to all of the compensation control signal lines Wth, the second scanning signal is applied to all of the gate lines, the reference voltage Vref is applied to all of the data lines, and the first light-emitting control signal is applied to all of the light-emitting control signal lines EM. During the reset sub-stage $t0_r$, the threshold storage control transistor T3, the compensation transistor T2, the isolation control transistor T5, and the light-emitting control transistor T4 are turned on, and the data writing transistor T6 is turned off. The turn-on of the compensation transistor T2 causes the driving transistor T1 to form a diode connection. This condition is shown in the equivalent circuit diagram in FIG. 4, the gate electrode and the second electrode of the driving transistor T1 charges the anode of the light-emitting diode OLED, such that a voltage at the gate electrode of the driving transistor T1 and the first terminal of the threshold storage subcircuit 110 is clamped to a voltage at the anode of the light-emitting diode OLED. In general, the voltage at the anode of the light-emitting diode OLED is less than the difference between the high-level voltage ELVdd supplied from the first power voltage signal terminal and the threshold voltage Vth of the driving transistor T1 (i.e., VA<ELVdd−Vth), so as to reset the gate electrode of the driving transistor T1. The reference voltage Vref is input to the second terminal of the threshold storage capacitor Cs-Vth (i.e., the second terminal B of the threshold storage subcircuit 110) through the turn-on of the threshold storage control transistor 3, so as to reset the second terminal B of the threshold storage subcircuit 110.

During the threshold voltage storage sub-stage $t0_0$ after the reset sub-stage $t0_r$, the first compensation control signal is applied to all of the compensation control signal lines Wth, the second scanning signal is applied to all of the gate lines, the reference voltage Vref is applied to all of the data lines, and the second light-emitting control signal is applied to all of the light-emitting control signal lines EM. In the threshold voltage storage sub-stage $t0_0$, the threshold storage control transistor T3 and the compensation transistor T2 are turned on, and the isolation control transistor T5, the light-emitting control transistor T4 and the data writing transistor T6 are turned off. This condition is shown in the equivalent circuit diagram in FIG. 5. At this time, the first power voltage signal terminal ELVdd charges the threshold storage capacitor Cs-Vth through the driving transistor T1 in the diode connection state, and at the same time, the reference voltage Vref written from the data line is also written into the threshold storage capacitor Cs-Vth, such that the voltage in the threshold storage capacitor Cs-Vth is ELVdd-|Vth|-Vref. At this stage, the threshold voltage of the driving transistor is stored in the threshold storage capacitor Cs-Vth. Specifically, the driving transistor T1 is in the diode connection state, as shown in the equivalent circuit in FIG. 5. A forward voltage across the driving transistor T1 is the threshold voltage Vth, the second terminal B of the threshold storage subcircuit 110 has a voltage of Vref, and the first terminal A of the threshold storage subcircuit 110 has a voltage of ELVdd-|Vth|. The amount of charges $Q_{CGS-T1}$ stored in the gate-source equivalent capacitor $C_{GS-T1}$ of the driving transistor T1 is represented by the following formula (1), the amount of charges $Q_{Cs-Vth}$ stored in the threshold storage capacitor Cs-Vth is represented by the following formula (2), the amount of charges stored in the data storage capacitor is maintained the same as the charge amount of the last frame, the total amount of charges $Q_A$ at the first terminal A of the threshold storage subcircuit 110 is represented by the following formula (3), and the total amount of charges $Q_B$ at the second terminal B of the threshold storage subcircuit 110 is represented by the following formula (4).

$$Q_{CGS-T1}=C_{GS-T1}\times|Vth| \quad (1)$$

$$Q_{Cs-vth}=C_{s-Vth}\times(\text{ELVdd}-|\text{Vth}|-\text{Vref}) \quad (2)$$

$$Q_A=C_{s-vth}\times(\text{ELVdd}-|\text{Vth}|-\text{Vref})-C_{GS-T1}\times|\text{Vth}| \quad (3)$$

$$Q_B=C_{s-Vth}\times(\text{ELVdd}-|\text{Vth}|-\text{Vref}) \quad (4)$$

Where $C_{s-Vth}$ is the capacitance of the threshold storage capacitor Cs-Vth, and ELVdd is the high-level voltage supplied by the first power voltage signal terminal ELVdd.

Figure 6:
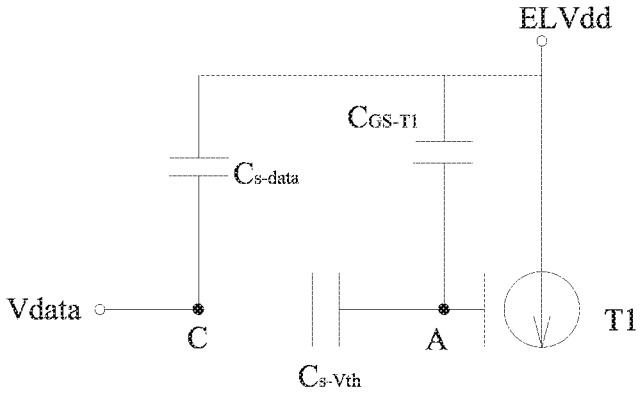
FIG. 6 is an equivalent circuit diagram of the pixel circuit shown in FIG. 2 during a data voltage writing sub-stage.

During the data voltage writing sub-stage t1, the second compensation control signal is applied to all of the compensation control signal lines Wth, the first scanning signal is sequentially applied to each gate line for a predetermined time, data voltages are applied to the corresponding data lines 100, respectively, and the second light-emitting control signal is applied to all of the light-emitting control signal lines EM. During the data voltage writing sub-stage t1, the light-emitting control transistor T4, the isolation control transistor T5, the compensation transistor T2, and the threshold storage control transistor T3 are turned off. Since the compensation transistor T2 is turned off, the driving transistor T1 does not exhibit the diode characteristic and is in an off-state. At this time, the gate line receives the first scanning signal, therefore the data writing transistor T6 in the pixel circuit corresponding to the gate line is turned on, so as to write the data voltage into the data storage capacitor Cs-data. The equivalent circuit of the pixel circuit that receives the first scanning signal is shown in FIG. 6. Since the isolation control transistor T5 is turned off, charges cannot leak to the threshold voltage storage transistor Cs-Vth from the data storage capacitor Cs-data. In this stage, when the scanning on all gate lines is finished, corresponding data voltages are stored in the data storage capacitors of all pixel circuits.

Since the driving transistor T1 is turned off, the gate-source equivalent capacitor CGS-T1 of the driving transistor T1 is negligible. The first terminal A and the second terminal B of the threshold storage subcircuit 110 are in a floating state, and a voltage at the second terminal C of the data storage subcircuit is Vdata. The voltage across the threshold storage capacitor Cs-Vth is ELVdd-|Vth|-Vref, the amount of charges $Q_{Cs\text{-}Vth}$ in the threshold storage capacitor Cs-Vth is $C_{s\text{-}Vth}$ ×(ELVdd-|Vth|-Vref), and the amount of charges $Q_{Cs\text{-}data}$ in the data storage capacitor is $C_{s\text{-}data}$×(ELVdd-Vdata).

The total amount of charges at the first terminal A of the threshold storage subcircuit 110 remains unchanged, as shown in formula (3). The total amount of charges $Q_B$ at the second terminal B of the threshold storage subcircuit 110 remains unchanged, as shown in formula (4). The total amount of charges Qc at the second terminal C of the data storage subcircuit is shown in the following formula (5):

$$Ac=-C_{s\text{-}data}\times(\text{ELVdd-Vdata})(5)$$

Figure 7:
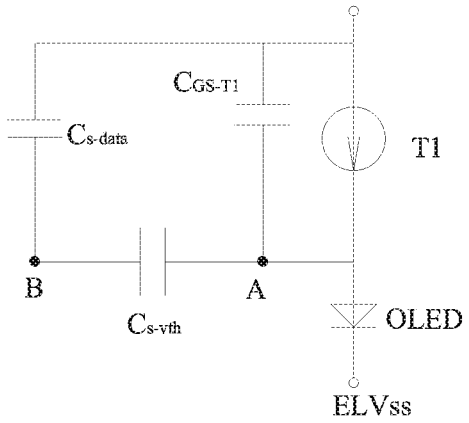
FIG. 7 is an equivalent circuit diagram of a pixel circuit according to the disclosure during a light-emitting sub-stage.

During the light-emitting sub-stage t2, the second compensation control signal is applied to all of the compensation control signal lines Wth, the second scanning signal is applied to all of the gate lines, and therefore a voltage on the data line is isolated from the data storage subcircuit and the threshold storage subcircuit, respectively. The first light-emitting control signal is applied to all of the light-emitting control signal lines EM. The light-emitting control transistor T4 and the isolation control transistor T5 are turned on, and the data writing transistor T6, the compensation transistor T2, and the threshold storage control transistor T3 are turned off. The equivalent circuit of the pixel circuit in light-emitting sub-stage is shown in FIG. 7, the voltage formed by the charges stored in the threshold storage subcircuit 110 and the charges stored in the data storage subcircuit 130 is applied to the gate electrode and the source electrode (i.e., the first electrode) of the driving transistor T1, such that the driving transistor T1 serves as a current source, and a driving current is generated.

The voltage $V_B$ at the second terminal B of the threshold storage subcircuit 110 is shown in the following formula (6), and the driving current $I_{sd\ (sat)}$ generated by the driving transistor T1 under the driving of the voltage $V_B$ at the second terminal B of the threshold storage subcircuit 110 is shown in the following formula (7).

$$V_B = ELVDD - |Vth| + \frac{C_{s-Vth}\times C_{s-data}}{C_{s-data}\times C_{s-Vth} + C_{s-data}\times C_{GS-T1} + C_{s-Vth}C_{GS-T1}}(Vdata - Vref) \quad (6)$$

$$I_{sd(sat)} = \frac{W\mu_p Cox}{2L}V_{SD(sat)}^2 = \frac{W\mu_p Cox}{2L}(V_{GS} + Vth) = \frac{W\mu_p Cox}{2L}\left[\frac{C_{s-Vth}\times C_{s-data}}{C_{s-data}\times C_{s-Vth} + C_{s-Vth}\times C_{GS-T1} + C_{s-Vth}C_{GS-T1}}(Vdata - Vref)\right]^2 \quad (7)$$

Wherein, $\mu_p$ is the mobility of the P-type MOS transistor; Cox is the intrinsic capacitance of the driving transistor; and $$\frac{W}{L}$$

is a width-to-length ratio of the driving transistor.

As can be seen from the formula (7), the driving current is independent of the threshold voltage of the driving transistor T1 and independent of the high-level signal supplied by the first power voltage signal terminal ELVdd. That is to say, the light emission of the light-emitting diode OLED is not affected by the non-uniform threshold voltage and the internal resistance drop (e.g., RC loading), thereby improving the light-emitting uniformity of the display panel.

In the embodiment of the disclosure, the driving transistor T1, the compensation transistor T2, the threshold storage control transistor T3, the light-emitting control transistor T4, the isolation control transistor T5, and the data writing transistor T6 are all P-type transistors, and accordingly, the first scanning signal has a low level, and the second scanning signal has a high level; the first light-emitting control signal has a low level, and the second light-emitting control signal has a high level; the first compensation control signal has a low level, and the second compensation control signal has a high level.

In another embodiment of the disclosure, the driving transistor T1, the compensation transistor T2, the threshold storage control transistor T3, the light-emitting control transistor T4, the isolation control transistor T5, and the data writing transistor T6 may alternatively be N-type transistors, and accordingly, the first scanning signal has a high level, and the second scanning signal has a low level; the first light-emitting control signal has a high level, and the second light-emitting control signal has a low level; the first compensation control signal has a high level, and the second compensation control signal has a low level.

As a third aspect of the disclosure, a method for driving the above display panel according to the disclosure is provided. A display period of each frame of image includes the field-blanking stage and the row scanning stage. The field-blanking stage includes the reset sub-stage and the threshold voltage storage sub-stage, and the row scanning stage includes the data voltage writing sub-stage and the light-emitting sub-stage. That is, in each display period, the driving method includes the reset sub-stage, the threshold voltage storage sub-stage, the data voltage writing sub-stage, and the light-emitting sub-stage.

During the reset sub-stage, the reference voltage is written, by the threshold storage control subcircuit, into the threshold storage subcircuit for resetting the threshold storage subcircuit.

During the threshold voltage storage sub-stage, the reference voltage is written, by the threshold storage control subcircuit, into the threshold storage subcircuit, and the threshold storage subcircuit stores the threshold voltage of the driving transistor in response to the first compensation control signal.

During the data voltage writing sub-stage, the data voltage is written, by the data writing control subcircuit, into the data storage subcircuit, and the isolation control subcircuit is turned off in response to the second light-emitting control signal.

During the light-emitting sub-stage, the threshold storage subcircuit and the data storage subcircuit apply the threshold voltage of the driving transistor and the data voltage to the driving transistor, respectively.

In the method for driving the display panel according to the disclosure, the reference voltage is written, by the threshold storage control subcircuit, into the threshold storage subcircuit, and the threshold storage subcircuit stores the threshold voltage of the driving transistor in response to the first compensation control signal; the data voltage is written, by the data writing control subcircuit, into the data storage subcircuit. During the data voltage writing sub-stage, the isolation control subcircuit is turned off in response to the second light-emitting control signal, thereby avoiding the mutual influence on voltages in the data storage subcircuit and the threshold storage subcircuit, and ensuring the stability of the circuit.

The method for driving the display panel according to an embodiment of the disclosure will be described in detail with reference to the accompanying drawings.

The display panel includes a plurality of gate lines, a plurality of data lines, and a plurality of light-emitting control signal lines. The plurality of gate lines intersect with the plurality of data lines, such that the display panel is divided into a plurality of pixel units. Each row of pixel units corresponds to one gate line and one light-emitting control signal line, and each column of pixel units corresponds to one data line. A pixel circuit is disposed in each pixel unit.

The display panel further includes compensation control signal lines, and each row of pixel units corresponds to one compensation control signal line. The control terminal of the data writing control subcircuit is electrically coupled to a corresponding gate line, the control terminal of the threshold storage subcircuit is electrically coupled to a corresponding compensation control signal line, and the input terminal of the data writing control subcircuit is electrically coupled to a corresponding data line.

During the reset sub-stage, a first compensation control signal is applied to all of the compensation control signal lines of the display panel, a second scanning signal is applied to all of the gate lines of the display panel, a first light-emitting control signal is applied to all of the light-emitting control signal lines of the display panel, and a reference voltage is applied to all of the data lines of the display panel, wherein the second scanning signal is opposite to the first scanning signal in phase.

During the threshold voltage storage sub-stage, the first compensation control signal is applied to all of the compensation control signal lines of the display panel, the second scanning signal is applied to all of the gate lines of the display panel, a second light-emitting control signal is applied to all of the light-emitting control signal lines of the display panel, and the reference voltage is applied, to all of the data lines of the display panel, wherein the second light-emitting control signal is opposite to the first light-emitting control signal in phase.

During the data voltage writing sub-stage, the second compensation control signal is applied to all of the compensation control signal lines of the display panel, the first scanning signal is sequentially applied to the gate lines in a predetermined scanning sequence, corresponding data voltages are applied to the data lines, respectively, and the second light-emitting control signal is applied to all of the light-emitting control signal lines of the display panel, wherein the first scanning signal is applied to each gate line for a predetermined time.

During the light-emitting sub-stage, the second compensation control signal is applied to all of the compensation control signal lines of the display panel, and the second scanning signal is applied to all of the gate lines of the display panel, such that the data line is disconnected from the data storage subcircuit and the threshold storage subcircuit, and the voltage on the data line cannot influence the charges in the storage capacitor. Further, the first light-emitting control signal is applied to all of the light-emitting control signal lines of the display panel.

In an embodiment of the disclosure, the driving transistor may be a P-type transistor, and, accordingly, the first scanning signal has a low level, the second light-emitting control signal has a high level, and the first compensation control signal has a low level.

The specific workflow of the driving method has been described in detail above, and will not be repeated in detail here.

According to the driving method according to the disclosure, the threshold voltage of the driving transistor is stored in the threshold storage subcircuit in the field-blanking stage, and the duration of the field-blanking stage is relatively long (the duration can be set as a time for scanning several gate lines or even several tens of gate lines), therefore the charging rate of the threshold storage subcircuit by the driving transistor in a case where the driving transistor is in the diode connection state can be improved, resulting in more accurate writing of the threshold voltage of the driving transistors and improved uniformity of light-emitting of the display panel. Further, the row scanning stage is divided into two phases including the data voltage writing sub-stage and the light-emitting sub-stage. During the data voltage writing sub-stage, scanning of pixel units in each row and writing of data voltages into pixel units in each column are performed, and during the light-emitting sub-stage, all the pixel units are controlled to emit light for collective display. In the disclosure, all the pixel units emit light generally in the second half of a frame, which is beneficial to the mixing of light in different colors emitted by the pixel units and better display effect. In addition, because the duration of the light-emitting sub-stage is less than or equal to the duration of one half of the frame, the light-emitting current of the driving transistor is increased, the driving dynamic range of the data voltage is improved, the channel length of the driving transistor is reduced, the driving current can be increased, and the energy consumption is reduced.

It should be understood that the above embodiments are merely exemplary embodiments for the purpose of illustrating the principles of the present disclosure, however, the present disclosure is not limited thereto. It will be apparent to those skilled in the art that various changes and modifications can be made without departing from the essence and spirit of the present disclosure, which are also to be regarded as falling within the scope of the present disclosure.

What is claimed is:

1. A pixel circuit, comprising a driving transistor, a threshold storage subcircuit, a threshold storage control subcircuit, a data storage subcircuit, a data writing control subcircuit, an isolation control subcircuit, a light-emitting control subcircuit and a light-emitting diode, wherein the threshold storage control subcircuit is electrically coupled to the threshold storage subcircuit and is configured to input a reference voltage into the threshold storage subcircuit in response to a first compensation control signal;

the threshold storage subcircuit is configured to store the reference voltage input by the threshold storage control subcircuit, and store a threshold voltage of the driving transistor in response to the first compensation control signal;

the data writing control subcircuit is electrically coupled to the data storage subcircuit, and is configured to input a data voltage into the data storage subcircuit in response to a first scanning signal;

the data storage subcircuit is configured to store the data voltage input by the data writing control subcircuit;

the isolation control subcircuit is coupled between the data storage subcircuit and the threshold storage subcircuit, and is configured to be turned off or turned on in response to a first light-emitting control signal or a second light-emitting control signal for disconnecting or connecting the data storage subcircuit from or to the threshold storage subcircuit; and the driving transistor is electrically coupled to the threshold storage subcircuit and the data storage subcircuit, respectively, and is configured to control the light-emitting diode to emit light under control of the light-emitting control subcircuit, based on the threshold voltage stored in the threshold storage subcircuit and the data voltage stored in the data storage subcircuit, wherein a gate electrode of the driving transistor is electrically coupled to a first terminal of the threshold storage subcircuit, a first electrode of the driving transistor is electrically coupled to a first power supply voltage signal terminal and a first terminal of the data storage subcircuit, respectively, and a second electrode of the driving transistor is electrically coupled to a first terminal of the light-emitting control subcircuit and a third terminal of the threshold storage subcircuit, respectively, wherein a second terminal of the threshold storage subcircuit is electrically coupled to a first terminal of the threshold storage control subcircuit and a first terminal of the isolation control subcircuit, respectively, and a control terminal of the threshold storage subcircuit is electrically coupled to a control terminal of the threshold storage control subcircuit, wherein a second terminal of the threshold storage control subcircuit is electrically coupled to an input terminal of the data writing control of the subcircuit, when the control terminal of the threshold storage control subcircuit and the control terminal of the threshold storage subcircuit receive the first compensation control signal, the second terminal of the threshold storage control subcircuit is electrically connected with the first terminal of the threshold storage control subcircuit, and the first terminal of the threshold storage subcircuit is electrically connected with the third terminal of the threshold storage subcircuit, such that the reference voltage input through the threshold stroage control subcircuit and the threshold voltage of the driving transistor are stored in the threshold storage subcircuit, wherein a second terminal of the data storage subcircuit is electrically coupled to a second terminal of the isolation control subcircuit, wherein an output terminal of the data writing control subcircuit is electrically coupled to the second terminal of the data storage subcircuit, and the input terminal of the data writing control subcircuit is electrically connected with the output terminal of the data writing control subcircuit when a control terminal of the data writing control subcircuit receives the first scanning signal, wherein a control terminal of the isolation control subcircuit is electrically coupled to a control terminal of the light-emitting control subcircuit, and the first terminal of the isolation control subcircuit is disconnected from the second terminal of the isolation control subcircuit when the control terminal of the isolation control subcircuit receives the second light-emitting control signal, and a second terminal of the light-emitting control subcircuit is electrically coupled to an anode of the light-emitting diode, and the first terminal of the light-emitting control subcircuit is coupled to the second terminal of the light-emitting subcircuit when the control terminal of the light-emitting control subcircuit receives the first light-emitting control signal.

2. The pixel circuit according to claim 1, wherein the isolation control subcircuit comprises an isolation control transistor, a gate electrode of the isolation control transistor serves as the control terminal of the isolation control subcircuit, a first electrode of the isolation control transistor serves as the first terminal of the isolation control subcircuit, and a second electrode of the isolation control transistor serves as the second terminal of the isolation control subcircuit, the first electrode of the isolation control transistor is electrically connected with the second electrode of the isolation control transistor when the gate electrode of the isolation control transistor receives the first light-emitting control signal, and the first electrode of the isolation control transistor is disconnected from the second electrode of the isolation control transistor when the gate electrode of the isolation control transistor receives the second light-emitting control signal, and the first light-emitting control signal is opposite to the second light-emitting control signal in phase.

3. The pixel circuit according to claim 1, wherein the data storage subcircuit comprises a data storage capacitor, a first terminal of the data storage capacitor serves as the first terminal of the data storage subcircuit, and a second terminal of the data storage capacitor serves as the second terminal of the data storage subcircuit.

4. The pixel circuit according to claim 1, wherein the data writing control subcircuit comprises a data writing transistor, a gate electrode of the data writing transistor serves as the control terminal of the data writing control subcircuit, a first electrode of the data writing transistor serves as the input terminal of the data writing control subcircuit, and a second electrode of the data writing transistor serves as the output terminal of the data writing control subcircuit, the first electrode of the data writing transistor is electrically connected with the second electrode of the data writing transistor when the gate electrode of the data writing transistor receives the first scanning signal, and the first electrode of the data writing transistor is disconnected from the second electrode of the data writing transistor when the gate electrode of the data writing transistor receives a second scanning signal, and the second scanning signal is opposite to the first scanning signal in phase.

5. The pixel circuit according to claim 1, wherein the threshold storage subcircuit comprises a compensation transistor and a threshold storage capacitor, a gate electrode of the compensation transistor serves as the control terminal of the threshold storage subcircuit, a first electrode of the compensation transistor serves as the first terminal of the threshold storage subcircuit, and a second electrode of the compensation transistor serves as the third terminal of the threshold storage subcircuit, the first electrode of the compensation transistor is electrically connected with the second electrode of the compensation transistor when the gate electrode of the compensation transistor receives the first compensation control signal, and the first electrode of the compensation transistor is disconnected from the second electrode of the compensation transistor when the gate electrode of the compensation transistor receives a second compensation control signal, the first compensation control signal being opposite to the second compensation control signal in phase, and a first terminal of the threshold storage capacitor is electrically coupled to the first electrode of the compensation transistor, and a second terminal of the threshold storage capacitor serves as the second terminal of the threshold storage subcircuit.

6. The pixel circuit according to claim 1, wherein the threshold storage control subcircuit comprises a threshold storage control transistor, a gate electrode of the threshold storage control transistor serves as the control terminal of the threshold storage control subcircuit, a first electrode of the threshold storage control transistor serves as the first terminal of the threshold storage control subcircuit, and a second electrode of the threshold storage control transistor serves as the second terminal of the threshold storage control subcircuit, and the first electrode of the threshold storage control transistor is electrically connected with the second electrode of the threshold control transistor when the gate electrode of the threshold storage control transistor receives the first compensation control signal, and the first electrode of the threshold storage control transistor is disconnected from the second electrode of the threshold control transistor when the gate electrode of the threshold storage control transistor receives the second compensation control signal, the first compensation control signal being opposite to the second compensation control signal in phase.

7. The pixel circuit according to claim 1, wherein the light-emitting control subcircuit comprises a light-emitting control transistor, a gate electrode of the light-emitting control transistor serves as the control terminal of the light-emitting control subcircuit, a first electrode of the light-emitting control transistor serves as the first terminal of the light-emitting control subcircuit, and a second electrode of the light-emitting control transistor serves as the second terminal of the light-emitting control subcircuit, and the first electrode of the light-emitting control transistor is electrically connected with the second electrode of the light-emitting control transistor when the gate electrode of the light-emitting control transistor receives the first light-emitting control signal, and the first electrode of the light-emitting control transistor is disconnected from the second electrode of the light-emitting control transistor when the gate electrode of the light-emitting control transistor receives the second light-emitting control signal, the first light-emitting control signal being opposite to the second light-emitting control signal in phase.

8. The pixel circuit according to claim 1, wherein the driving transistor is a P-type transistor, the first scanning signal has a low level, the second light-emitting control signal has a high level, and the first compensation control signal has a low level.

9. A display panel comprising a plurality of gate lines, a plurality of data lines, and a plurality of light-emitting control signal lines, wherein the plurality of gate lines intersect with the plurality of data lines such that the display panel is divided into a plurality of pixel units, each row of pixel units corresponds to one gate line and one light-emitting control signal line, each column of pixel units corresponds to one data line, and a pixel circuit is provided in each pixel unit, and the display panel further comprises a plurality of compensation control signal lines, each row of pixel units corresponds to one compensation control signal line, the pixel circuit is the pixel circuit according to claim 1, a control terminal of the data writing control subcircuit is electrically coupled to a corresponding gate line to receive the first scanning signal or a second scanning signal applied via the gate line; a control terminal of the threshold storage subcircuit is electrically coupled to a corresponding compensation control signal line to receive the first compensation control signal or a second compensation control signal in the same pixel circuit applied via the compensation control signal line; an input terminal of the data writing control subcircuit is electrically coupled to a corresponding data line to receive the reference voltage or the data voltage applied via the data line; a second terminal of the threshold storage control subcircuit is electrically coupled to a corresponding data line to receive the reference voltage applied via the data line; and a control terminal of the threshold storage control subcircuit is electrically coupled to a corresponding compensation control signal line to receive the first compensation control signal or a second compensation control signal in the same pixel circuit applied via the compensation control signal line.

10. A method for driving a display panel, wherein the display panel is the display panel according to claim 9, a display period of each frame of image comprises a field-blanking stage and a row scanning stage, the field-blanking stage comprises a reset sub-stage and a threshold voltage storage sub-stage, and the row scanning stage comprises a data voltage writing sub-stage and a light-emitting sub-stage, and the method comprises steps of:

during the reset sub-stage, inputting, by the threshold storage control subcircuit, the reference voltage into the threshold storage subcircuit to reset the threshold storage subcircuit;

during the threshold voltage storage sub-stage, inputting, by the threshold storage control subcircuit, the reference voltage into the threshold storage subcircuit, and storing, by the threshold storage subcircuit, the threshold voltage of the driving transistor in response to the first compensation control signal;

during the data voltage writing sub-stage, inputting, by the data writing control subcircuit, the data voltage into the data storage subcircuit, and turning off the isolation control subcircuit in response to the second light-emitting control signal; and during the light-emitting sub-stage, inputting the threshold voltage of the driving transistor and the data voltage, by the threshold storage subcircuit and the data storage subcircuit, to the driving transistor, respectively.

11. The method according to claim 10, further comprising:

during the reset sub-stage, applying the first compensation control signal to all of the compensation control signal lines of the display panel, applying a second scanning signal to all of the gate lines of the display panel, applying first light-emitting control signal to all of the light-emitting control signal lines of the display panel, and applying the reference voltage to all of the data lines of the display panel, the second scanning signal being opposite to the first scanning signal in phase;

during the threshold voltage storage sub-stage, applying the first compensation control signal to all of the compensation control signal lines of the display panel, applying the second scanning signal to all of the gate lines of the display panel, applying the second light-emitting control signal to all of the light-emitting control signal lines of the display panel, and applying the reference voltage to all of the data lines of the display panel, the second light-emitting control signal being opposite to the first light-emitting control signal in phase;

during the data voltage writing sub-stage, applying the second compensation control signal to all of the compensation control signal lines of the display panel, applying the first scanning signal to the gate lines in predetermined scanning sequence, applying corresponding data voltages to the data lines, and applying the second light-emitting control signal to all of the light-emitting control signal lines of the display panel, wherein the first scanning signal is applied to each gate line for a predetermined time; and during the light-emitting sub-stage, applying the second compensation control signal to all of the compensation control signal lines of the display panel, applying the second scanning signal to all of the gate lines of the display panel, and applying the first light-emitting control signal to all of the light-emitting control signal lines of the display panel.

12. The method according to claim 10, wherein the driving transistor is a P-type transistor, the first scanning signal has a low level, the second light-emitting control signal has a high level, and the first compensation control signal has a low level.

13. The method according to claim 11, wherein the driving transistor is a P-type transistor, the first scanning signal has a low level, the second light-emitting control signal has a high level, and the first compensation control signal has a low level.

* * * * *